US005668540A

United States Patent [19]

Bailleul et al.

[11] Patent Number: 5,668,540

[45] Date of Patent: Sep. 16, 1997

[54] DETECTION DEVICE FOR DATA RELATING TO THE PASSAGE OF VEHICLES ON A ROAD

[75] Inventors: Gilles Bailleul, Carrieres-sur-Seine; Francois Paris, Croissy-sur-Seine, both of France

[73] Assignee: U.S. Philips Corporation, New York, N.Y.

[21] Appl. No.: 413,748

[22] Filed: Mar. 30, 1995

[30] Foreign Application Priority Data

Mar. 30, 1994 [FR] France ..... 94 03774

[51] Int. Cl.[6] ..... G08G 1/01

[52] U.S. Cl. ..... 340/933; 340/666; 340/941; 377/9; 200/86 A; 701/121

[58] Field of Search ..... 340/933, 940, 340/941, 934, 936, 939, 666, 665; 364/436 A, 438; 116/63 R; 377/9; 310/800; 200/86 A, 86 R

[56] References Cited

U.S. PATENT DOCUMENTS

| | | | |
|---|---|---|---|
| 3,105,952 | 10/1963 | Kidder | 340/940 |
| 5,008,666 | 4/1991 | Gebert | 340/939 |
| 5,206,642 | 4/1993 | Gregoire | 340/933 |
| 5,450,077 | 9/1995 | Tyburski | 340/941 |
| 5,477,217 | 12/1995 | Bergan | 340/665 |

FOREIGN PATENT DOCUMENTS

| | | | |
|---|---|---|---|
| 0231669 | 1/1986 | European Pat. Off. . | |
| 0287250 | 10/1988 | European Pat. Off. | 340/933 |
| 0425977 | 5/1991 | European Pat. Off. | 340/941 |
| 0456325 | 11/1991 | European Pat. Off. . | |
| 2482340 | 11/1981 | France . | |
| 2487555 | 1/1982 | France | 340/933 |
| 9302938 | 7/1993 | Germany . | |
| 4219198 | 8/1990 | Japan | 340/940 |
| 8600475 | 9/1987 | Netherlands | 340/933 |
| 2084774 | 4/1982 | United Kingdom | 340/933 |
| 2234380 | 1/1991 | United Kingdom | 340/941 |

*Primary Examiner*—Jeffery Hofsass
*Assistant Examiner*—Edward Lefkowitz
*Attorney, Agent, or Firm*—Robert J. Kraus

[57] ABSTRACT

A detection device for data relating to the passage of vehicles over a road. The detection device is to be placed in a groove provided in the upper portion of the road and comprises a first profiled strip provided with an upper cavity in a U-shape, and a piezoelectric cable of the coaxial type arranged in the bottom of the cavity of the first profiled strip. A second profiled strip is arranged in the cavity of the first profiled strip on top of the coaxial cable. The second strip has a shape and dimensions such that it fills up the remaining volume of the cavity above the cable and seals this cavity.

15 Claims, 1 Drawing Sheet

DETECTION DEVICE FOR DATA RELATING TO THE PASSAGE OF VEHICLES ON A ROAD

BACKGROUND OF THE INVENTION

This invention relates to a detection device for data relating to the passage of vehicles on a road, which device is to be placed in a groove provided in the upper portion of said road and comprises a first profiled strip having an upper U-shaped cavity and a coaxial piezoelectric cable arranged in the bottom of the cavity of said first profiled strip.

The invention is used for the detection of the passage of vehicles, counting, speed measurements, measurements of vehicle weights (dynamic loads) and the classification thereof, in geographic regions of widely differing, and especially extreme weather conditions (very hot, moderate, or very cold climates).

Patent FR 2 482 340 describes a vehicle passage detection device for a road, its installation method and its use in the detection of speeds.

This device is partly formed by a cable which operates piezoelectrically. This cable is a coaxially shielded cable whose core and sheath are separated by a piezoelectric ceramic material. This cable has an external diameter of a few millimeters and a length of the order of 1 m or more. It is accordingly very long and thin.

To increase the useful life of the piezoelectric cable, facilitate its installation in the road, and ensure a certain reliability of the measurements, this piezoelectric cable is arranged in the bottom of a rigid metal or hard-plastic profiled strip having either a U-shape or the shape of a rectangle of which the upper face has been caved in. This strip is internally filled with a synthetic resin material which can be hardened by polymerization. The object is to provide a rigid device.

In a modification of this device, the rigid profile is surrounded with a moulded envelope of flexible synthetic resin over its free surfaces which are not to come into contact with the vehicles, for example, an elastomer-filled resin which is to absorb the vibrations. This arrangement is realised in the factory.

In either case, the installation method for the device comprises the formation of a groove in the road of dimensions slightly greater than those of the device. Subsequently, the bottom and the sides of the groove are lined with a flexible synthetic resin material which absorbs vibrations, and finally the device is placed in the lined groove so that it remains fixed therein, while it is made to project slightly from the upper surface of the road. If the profile has a U-shape, the upper portions of the legs of the U will project from the upper surface of the road by a few millimeters. Lining of the groove is not absolutely necessary because the device already comprises a moulded envelope of a flexible plastic realised in the factory.

A disadvantage of the prior-art device described above is that its manufacture involves the use of synthetic resin materials, which are organic materials and which are particularly sensitive to temperature variations.

Now it is an object of the invention not only to detect the speed of vehicles, but also to count them, and to detect the weights of moving vehicles (measurement of dynamic charges), and to classify them. The detection and analysis of such data is particularly important for the planning of new roads, new bridges, or road surfaces of any kind, as well as for providing their maintenance.

If organic materials are used for realising detection devices, the measurements are not reliable as regards the detection of vehicle weights, because these measurements depend on climatic conditions. Depending on the situation, these measurements may be non-reproducible, or even impossible in regions where the climatic conditions are extreme.

If it is also necessary to use a plastic material for fixing the device in the road, moreover, the difficulties or impossibilities will manifest themselves in regions where the climatic conditions are extreme (torrid heat, extreme cold, very high humidity, huge climatic differences between the seasons or between day and night, etc.).

Another disadvantage of the known device is that the polymerizable plastic material for filling the U-profile is fragile, has bad ageing properties, and easily disengages itself from the walls of this hard protective profile. This means that the device obtained is not capable of any flexion. In its first embodiment, the device is accordingly fragile in a general sense, especially when used on a deformed or curved road surface; and it is particularly ill adapted to the measurement of moving loads.

In its second embodiment, it is still not flexible, and it is still fragile owing to the use of synthetic resins, but it is better adapted to the measurement of moving loads because of its moulded envelope. In this case, still, it will be difficult and expensive to realise, indeed, the realisation of an added moulded envelope implies the manufacture of a mould, which must be changed whenever those skilled in the art want to modify the length or transverse dimensions of the devices: and indeed the devices must have different lengths depending on the use for which they are designed: measurements on local roads, on motorways, measurements based on half the shaft or the whole shaft of a vehicle, the use of piezoelectric cables of different diameters, etc. Moreover, a mould will deteriorate during use.

Finally, stripping the device from the mould is difficult because of the fragility of the thermosetting resin with which the profile is fired.

A detection device for data relating to the passage of vehicles is also known from the prior-art Patent Application EP 0 231 669, which device is to be inserted into a groove provided in a road and also comprises a piezoelectric cable protected by a hard U-shaped profile, and is embedded in a filling material of the profile. In this second cited document, the profiled strip has a substantially square cross-section and is made from metal, for example, aluminium. The cable is at a given distance from the bottom of the profile and the filling material for embedding the cable is a silican-filled epoxy compound. The sides of the U-profile are provided with an elastomer foam for absorbing longitudinal bending. The assembly is introduced into a groove provided in the road and is again embedded in a silican-filled epoxy compound.

This second cited device has two advantages over the first cited device, i.e.: an improved performance in the measurement of moving loads because it is accurately sensitive to vertical pressures, and an improved resistance to weather conditions because the silican-filled epoxy compound acting as the filling material is especially provided for this purpose. But it also has major disadvantages: the first disadvantage, which was also present in the first cited device, lies in the fact that this second device is not any more flexible, because the silican-filled filling resins are very brittle. The second disadvantage is that it is even more expensive to implement than the second modification of the first device because of its highly complicated structure. Moreover, positioning of the piezoelectric cable at a given distance from the bottom of the profile is difficult to realise because it is not easy to keep the thin, long cable at a well-defined distance during this filling operation.

SUMMARY OF THE INVENTION

It is an object of the present invention to provide a detection device for data relating to the passage of vehicles on a road and which is capable of performing equally well in simple measurements such as measuring vehicles, or counting of speeds, as in the measurement of moving loads.

Another object of the invention is to provide such a device which is capable of yielding the various types of measurements over a wide temperature range.

Another object of the invention is to provide such a device which is especially capable of offering mechanical resistance both to extreme weather conditions and to the repeated passage of heavy vehicles.

Another object of the invention is to provide such a device which is flexible and can be installed in the upper surface of roads, possibly subject to deformations over time, for example, through the effect of weather conditions such as bulging owing to rain or frost, cracking, formation of grooves, etc.

Another object of the invention is to provide such a device which is very simple to realise and very inexpensive, and which in addition is easy to install in the road, so that the traffic need only be interrupted for a very short time when it is installed.

These objects are achieved by means of a detection device as defined in the opening paragraph which is in addition characterized in that it comprises a second profiled strip arranged in the cavity of the first profiled strip above the coaxial cable, which second profiled strip has a shape and dimensions such that it fills up completely the remaining volume of the cavity above the cable and closes off said cavity.

The device according to the invention has several special advantages:

- it has a good performance over a wide temperature range,
- it can be used for all kinds of measurements relating to the detection of dynamic loads or other data on vehicles,
- the pressures exerted by the vehicles or by the dynamic loads are correctly transmitted, i.e. it is accurately sensitive to vertical pressures,
- it exhibits a narrow dispersion of measurement characteristics,
- it is highly resistant to extreme weather conditions and to mechanical degradation factors,
- it is sufficiently flexible for installation in all locations,
- it is formed from materials which age well and are not brittle upon bending,
- its manufacture is very simple, fast, and inexpensive, while its performance is very good,
- it is easy to install in a road: the time required for its installation is short and the installation means to be used are inexpensive, and
- it is easy to transport before its installation.

BRIEF DESCRIPTION OF THE DRAWINGS

The invention will be described below in detail with reference to the annexed Figures, in which.

DESCRIPTION OF THE PREFERRED EMBODIMENTS

Figure 1A:
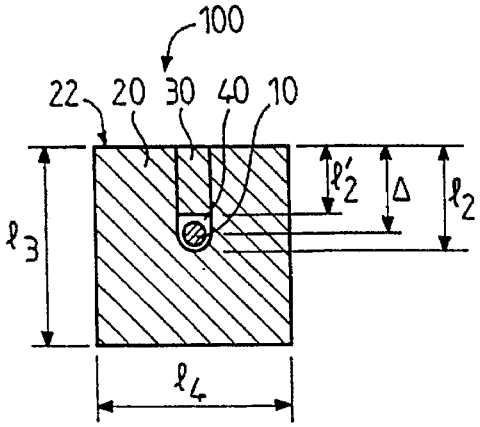
FIG. 1A shows in cross-section, a device comprising two profiled strips and holding a piezoelectric coaxial cable.
Figure 3A:
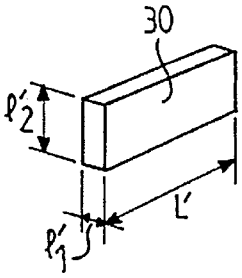
FIGS. 3A and 3B show the two profiles used in the embodiments illustrated in FIGS. 1A and 1B, in perspective view.
Figure 3B:
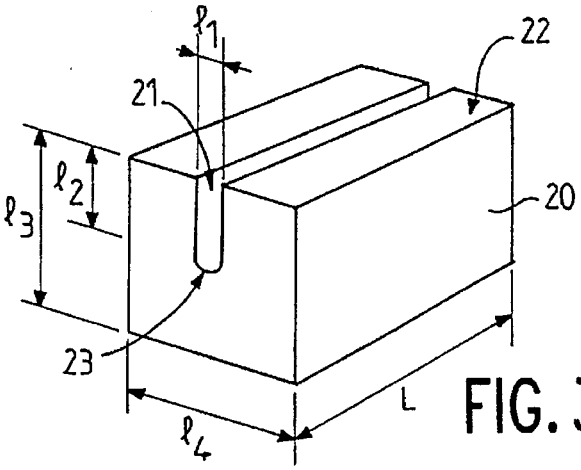

As is shown in FIGS. 1A in cross-section and in 1B in longitudinal section, a detection device 100 for measuring data relating to dynamic loads and to the passage of vehicles over a road comprises the following elements, with the object of being subsequently arranged in a groove at the surface of the road:

- a coaxial piezoelectric cable 10 of small external diameter $d_1$, for example, a few millimeters. The coaxial piezoelectric cable 10 may have a length D from a few tens of cm to several m;
- a first profiled strip 20, as also shown in perspective view in FIG. 3B, provided with a cavity 21 in the shape of a U in its upper portion 22. This cavity 21 has a transverse dimension $l_1$ of a value sufficient for accommodating the piezoelectric cable 10, i.e. this dimension $l_1$ is slightly greater than the diameter $d_1$. Cavity 21 in addition has a depth $l_2$ in relation to the upper surface 22 of the profile such that, when the piezoelectric cable 10 is arranged in the bottom 23 of the cavity 21, it is at an appropriate distance Δ from the surface of the road once the device 100 is installed in a groove provided in the road. The first profiled strip 20 has a length L slightly greater than that of the coaxial cable 10, and the cavity 21 is provided over this entire length L. Furthermore, the first profiled strip 20 has external transverse dimensions, height and width, $l_3$, $l_4$ which are great compared with those of the cavity 21; i.e. the width $l_4$ is approximately 5 to 10 times the width $l_1$; and the height $l_3$ approximately 2 to 3 times the depth $l_2$.
- a second profiled strip 30, as also shown in perspective view in FIG. 3A, having a transverse dimension $l'_1$ just smaller than the transverse dimension $l_1$ of the cavity 21 of the first profiled strip 20 so as to be introduced into said cavity when the coaxial cable 10 has been installed in the bottom 23 of this cavity; and having a height $l'_2$ such that it completely fills up and closes off the remaining free volume of the cavity 21 of the first strip when this second strip 30 is placed on top of the coaxial cable 10 in the cavity 21. This second profiled strip 30 has a length L' identical to the length L of the first profiled strip 20 and the cavity 21.

In a preferred embodiment:

- the coaxial piezoelectric cable has an external diameter $d_1$ of the order of 3 mm. The diameter $d_1$ may be chosen differently subject to the desired detection sensitivity, given the fact that the sensitivity of a piezoelectric cable increases proportionately with its diameter;
- this piezoelectric cable in addition has a total length D which may be either 2 m for measurements relating to the passage of half a shaft (one wheel), or 3.10 m for measurements relating to the passage of a complete shaft (two wheels mounted on either side);
- the first profiled strip 20 has external dimensions $l_3$, $l_4$ which are both approximately 20 mm. In this first profiled strip, the cavity depth $I_2$ is of the order of 10 mm and its transverse dimension $l_1$ is then of the order of 3.2 mm, slightly greater than diameter $d_1$;

the second profiled strip 30 has a transverse dimension $l'_1$ just smaller than the transverse dimension $l_1$ of the cavity 21, i.e. approximately 3 mm, and its height $l'_2$ is of the order of 8.5 mm so as to fill up entirely and close off the cavity 21 when the cable 10 is in position at the bottom 23 of this cavity.

In this preferred embodiment, the total length L and L' of the two strips 20 and 30 is 3.20 m±1 cm, and the other tolerances are generally ±0.1 mm.

The two strips 20 and 30 are made of selected materials in order to obtain the desired performance of the device for measuring dynamic loads, for detecting the passage or measuring the speed of vehicles, in combination with its desired temperature behaviour and resistance to mechanical degradation.

According to the invention, the material is preferably formed on the basis of a body made of glass fibre wires or fabric which is first impregnated with resin (polyester or epoxy phenol), and which is subsequently drawn through an extrusion head while in addition being heated for enabling the polymerization of the impregnating resin.

These profiles then offer numerous advantages:

these profiles have a high mechanical resistance, the shapes of these profiles may be realised as required in factories or production units specialized in the manufacture of laminated glass fibre articles. Since these articles are manufactured on an industrial scale, in medium or large quantities, they are inexpensive and their performance is reproducible (example: PULTRUSION Company, Z.I de NOGEL, 60870 Villers-St-Paul, FRANCE);

these profiles correctly transmit vertical pressures so as to allow the piezoelectric cable to carry out the desired detections and measurements;

these profiles are simultaneously sufficiently rigid and sufficiently flexible for easy transport of the devices before their installation and the installation of the devices in all kinds of unfavourable environments.

According to the invention, assembling together of the three components 10, 20, 30 is very easy:

1) the first profiled strip 20 is laid out, 2) the cable 10 is placed in the bottom of the cavity 21, 3) a glue 40 is spread over the cable, in a slight excess quantity; the glue may be, for example, an epoxy resin such as AW116 CIBA GEIGY, 4) the second profiled strip is placed on top of the cable in the cavity so that the glue penetrates and rises between the first and the second profiled strip along the vertical surfaces of the U-shaped cavity, 5) the glue is polymerized.

According to the invention, the epoxy resin is used in a small quantity solely to keep the components in place relative to one another, it does not form a material for the transmission of pressures. Accordingly, it does not represent a working surface—in contrast to what happens especially according to the first cited prior-art document. In the device made in accordance with the invention, accordingly, there are no disadvantages which were inherent in the use of the epoxy resin in the known devices according to this prior art.

In the device according to the invention, the first means for protecting the piezoelectric cable—which in the prior-art were formed by a hard U-shaped structure, and the second means for encapsulating the cable—which in the prior art were filling up with the epoxy resin only—are combined and completely realised by the envelope formed by the first and second profiled strip, while the resin as a result plays a secondary role which is limited to gluing together of the components.

Moreover, since the profiles are made of glass fibre impregnated with resin, the resin added for gluing is perfectly adapted to this former material and correctly performs its function: it adheres perfectly to the profile walls and there is no risk that it will disengage itself, as was the case with the resin filling the aluminium profiles, for example, in the relevant prior art.

The device obtained in accordance with the invention may thus be slightly curved without deterioration; it has good ageing properties, its life is prolonged, and it retains its performance under all climatic conditions.

The device 100 according to the invention has shown in tests:

a sensitivity of: 0.78 V/bar a homogeneity of ±6.8%.

For comparison, the standards imposed by the French ministry of transport are:

homogeneity for measuring dynamic loads: ±7% homogeneity for counting of vehicles: ±20%.

Figure 2:
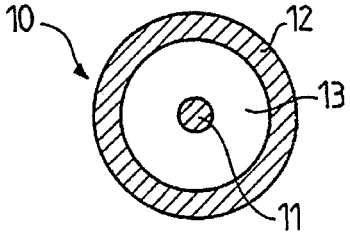
FIG. 2 shows in cross-section, shows a piezoelectric coaxial cable.

FIG. 2 shows a coaxial piezoelectric cable 10 in cross-section, comprising:

a metal core 11, usually of copper, with a diameter $d_2$ of approximately 1 mm, a metal sheath 12, usually made of copper, with an external diameter $d_1$ of approximately 3 mm, a compacted piezoelectric powder 13 as a filling between the metal core 11 and the metal sheath 12, for example, the powder "PXE5" manufactured by PHILIPS. A piezoelectric cable which is particularly suitable for use in the invention is the VIBRACOAX cable, reference "30 P1C" from the THERMOCOAX Company (SURESNES-FRANCE).

Figure 1B:
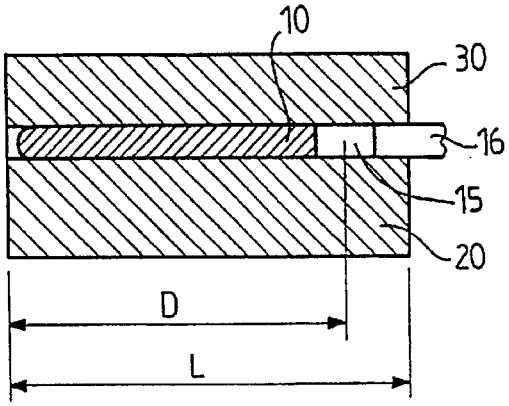
FIG. 1B shows the device in longitudinal sectional view.

As FIG. 1B shows, the coaxial piezoelectric cable 10 is connected to a coaxial transmission cable 16 by means of a connector 15. A cable "RG 58 Cu" from the THERMOCOAX Company is preferably used in combination with the VIBRACOAX piezoelectric cable. Owing to the diameter of the coaxial cable used, the connection between this coaxial cable 10 and the transmission and extension cable 16 will always be fragile; to counteract this disadvantage it suffices to envelop the connector 15 and a small length of the extension cable in the system formed by the first and second profiles 20, 30, and to glue them with the glue 40 by the method of the invention.

The operation of a piezoelectric cable for the detection of pressure is well known to those skilled in the art: when the piezoelectric material is submitted to an external pressure—here the piezoelectric material is submitted to a radial pressure inside the cable 10—it supplies electric charges which are collected by the central conductor 11 or metal core of the cable 10. The metal sheath is connected to ground.

To obtain this effect, the compacted piezoelectric powder undergoes a radial polarization treatment during the manufacture of the cable and as a result exhibits a sensitivity of the order of 1 V/bar.

Figure 4:
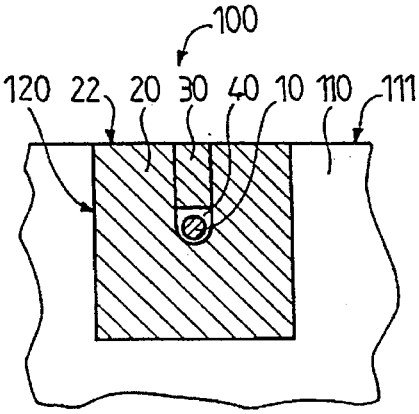
FIG. 4 shows in cross-section, shows a device as shown in FIGS. 1A and 1B installed in a road.

As seen in FIG. 4, once the device 100 according to the invention has been finished, a trench 120 or groove is made transversely to the upper surface 111 of a road 110 in the region where the measurements are required. When the device 100 according to the invention has external dimensions $l_3$, $l_4$ of the order of 20 mm, the trench 120 is realised with dimensions slightly greater than that by means of a mechanical device suitable for cutting road surfaces. Then the device 100 is installed in this trench 120. It is simple to retain the device 100 in the trench 120.

The device 100 is held at the correct height relative to the upper road surface and it is glued with a material which depends on the road material. This may be an epoxy resin filled with sand which combines well with a concrete road, or methyl methacrylate which combines better with asphalt. Other glues may be used depending on the type of asphalt or the type of special road surface.

Thus provided, the device 100 is submitted to pressures, to which it responds by the emission of electrical signals, during the passage of vehicle wheels over the road.

The device 100 is connected to suitable measuring apparatuses via the transmission cable 16, which apparatuses are not shown since they do not form a part of the invention proper and which process the emitted electrical signals, providing relevant data on dynamic loads, traffic detection, and/or the speeds of vehicles, etc. . . .

We claim:

1. A detection device for arrangement in a groove provided in an upper portion of a road to produce data relating to the passage of a vehicle, said detection device comprising:

a. an elongated substantially-rigid first body comprising an inorganic material and having a longitudinally-extending cavity with a predefined cross-sectional shape having predetermined dimensions;

b. a coaxial piezoelectric cable disposed at a predetermined position in the cavity; and c. a preformed, elongated, substantially-rigid second body comprising an inorganic material and slidably fitted into the cavity, said second body being shaped and dimensioned such that it fills the cavity above the cable.

2. A detection device as in claim 1 where at least one of the first and second bodies comprises a glass fiber material.

3. A detection device as in claim 1 where the glass fiber material is impregnated with a polymerized resin.

4. A detection device as in claim 1 comprising an adhesive for fixing the first and second bodies in position relative to each other.

5. A detection device as in claim 4 where the adhesive comprises a polymerizable resin.

6. A detection device for arrangement in a groove provided in an upper portion of a road to produce data relating to the passage of a vehicle, said detection device comprising:

a. an elongated substantially-rigid first body having a longitudinally-extending cavity with a predefined cross-sectional shape having predetermined dimensions;

b. a coaxial piezoelectric cable disposed at a predetermined position in the cavity; and c. a preformed, elongated, substantially-rigid second body slidably fitted into the cavity, said second body being shaped and dimensioned such that it fills the cavity above the cable, wherein said first and second bodies are made of a glass fiber material impregnated with a polymerized resin.

7. A detection device as in claim 6, comprising an adhesive for fixing the first and second bodies in position relative to each other, and where the adhesive comprises a polymerizable resin compatible with the polymerized resin impregnating the glass fiber.

8. A detection device as in claim 6 where said device is arranged in said groove provided in the upper portion of the road and is positioned such that an upper portion of each of the first and second bodies project above a surface of said road, and is fixed in position with a material which is a compound of a road material and of the polymerizable resin compatible with the polymerized resin impregnating the glass fiber.

9. A detection device as in claim 1, 4 or 6 where the piezoelectric cable comprises a metal core, a metal sheath, and a piezoelectric ceramic material arranged densely between the core and the sheath.

10. A detection device as in claim 9 where the cavity has a length which is longer than the piezoelectric cable disposed therein and includes a portion for containing, between the first and second bodies:

a. an end of a transmission cable for transmission of the data to apparatus for processing the data; and b. connector means for electrically connecting said end of the transmission cable to the piezoelectric cable.

11. A detection device as in claim 9 where said device is arranged in said groove provided in the upper portion of the road and is positioned such that an upper portion of each of the first and second bodies project above a surface of said road.

12. A detection device as in claim 10 where said device is arranged in said groove provided in the upper portion of the road and is positioned such that an upper portion of each of the first and second bodies project above a surface of said road.

13. A detection device as in claim 1, 6, 7 or 8 where the length of the piezoelectric cable and of the first and second bodies is between 20 cm and 5 m, the diameter of the piezoelectric cable is approximately 3 mm, the transverse dimension ($l_1$) of the longitudinally-extending cavity is slightly greater than the diameter of the cable by a few tenths of a mm, and the transverse dimension ($l'_1$) of the second body is approximately equal to the diameter ($d_1$) of the piezoelectric cable.

14. A detection device as in claim 1, 6 or 7 where the transverse external dimension ($l_4$) of the first body is 5 to 10 times the transverse dimension ($l_1$) of the cavity, and the height of said first body is approximately 2 to 3 times the height ($l_2$) of the cavity.

15. A detection device as in claim 1, or 6 where the piezoelectric cable is disposed in a bottom portion of the cavity.

* * * * *